US006231389B1

(12) United States Patent
Lai

(10) Patent No.: US 6,231,389 B1
(45) Date of Patent: May 15, 2001

(54) ELECTRONIC CARD CONNECTOR

(75) Inventor: Chin-Te Lai, Tao-Yuan (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/334,692

(22) Filed: Jun. 16, 1999

(30) Foreign Application Priority Data

Nov. 20, 1998 (TW) ..... 87219267

(51) Int. Cl.[7] ..... H01R 13/648
(52) U.S. Cl. ..... 439/607; 439/95
(58) Field of Search ..... 439/92, 95, 609, 439/607, 939

(56) References Cited

U.S. PATENT DOCUMENTS 5,158,473 * 10/1992 Takahashi et al. ..... 439/353
5,306,196 * 4/1994 Hashiguchi ..... 439/607
5,749,741 * 5/1998 Bellas et al. ..... 439/95
6,008,994 * 12/1999 Bates ..... 361/737

* cited by examiner

*Primary Examiner*—Khiem Nguyen
(74) *Attorney, Agent, or Firm*—Wei Te Chung

(57) ABSTRACT

An electronic card connector includes an insulative housing fixed in a casing of an electronic card with an outer face thereof exposed through an opening defined in the casing. The housing defines a slot for receiving a mating connector and retains a plurality of contact elements therein for electrically engaging with the mating connector. A pair of deflectable arms extend into the slot. Each arm resiliently supports a barb for engaging with and retaining the mating connector in the slot. A third arm is formed on a bottom side of the slot and supports a tab for engaging with the mating connector. A shielding member is positioned on and attached to the housing with two J-shaped end sections of the shielding member fit over two end blocks of the housing. The shielding member has two inclined resilient arms engaging with a flange of the casing thereby retaining and electrically grounding the connector.

14 Claims, 13 Drawing Sheets

ELECTRONIC CARD CONNECTOR

BACKGROUND OF THE INVENTION

1. Field of the Invention

The present invention generally relates to an electronic card connector mounted in an electronic card for establishing electrical connection between the card and an external device, and in particular, to a compact electronic card connector having an electromagnetic interference (EMI) shield.

2. The Prior Art

The memory and functional ability of a computer, especially a notebook computer, is often expanded by means of an electronic card releasably and selectively connected thereto. The electronic card is provided with a connector for connecting with the notebook computer. FIG. 11 of the attached drawings shows a conventional electronic card connector 6. FIG. 12 is a cross-sectional view of the conventional connector 6 fixed in a metal casing 91 of an electronic card. The conventional connector 6 comprises an insulative housing 61 having an exposed outer face 62 for engaging a mating connector (not shown) mounted in a notebook computer and an inner face 63. A slot 64 is defined in the housing 61 and exposed to the outer face 62 for receiving the mating connector. A tongue 65 is fixed in the slot 64 and defines a plurality of passageways 66 in opposite surfaces thereof. The passageways 66 are further defined with channels 67 exposed to the inner face 63.

A contact element 7 is received in each of the channels 67 and has a mating end section 71 located in the corresponding passageway 66 for electrically engaging with the mating connector and a mounting end section 72 extending beyond the inner face 63 of the housing 61 for electrically engaging with a circuit board 8 of the electronic card.

However, since the mating connector is simply inserted into the slot 64 and retained by a frictional force formed therebetween, the connection is not sound and an unexpected disengagement may easily occur. Furthermore, although the casing 91 of the electronic card is made of metal engaging with grounding pins 73 of the connector 6 for providing a grounding path for electrostatic discharge, due to manufacturing tolerance, gaps exist between the metal casing 91 of the electronic card and the connector 6 thereby weakening EMI protection thereof.

It is thus desirable to provide an electronic card connector capable of securely retaining a mating connector therein and comprising an EMI shield for improving EMI protection.

SUMMARY OF THE INVENTION

Accordingly, an object of the present invention is to provide an electronic card connector comprising latching members for engaging with a mating connector inserted therein to securely retain the mating connector.

Another object of the present invention is to provide an electronic card connector comprising a shielding member for providing EMI protection.

To achieve the above objects, an electronic card connector in accordance with the present invention comprises an insulative housing fixed in a casing of an electronic card with an outer face thereof being exposed through an opening defined in the casing. The housing defines a slot for receiving a mating connector and retains a plurality of contact elements therein for electrically engaging with the mating connector. A pair of deflectable arms extend into the slot. Each arm resiliently supports a barb for engaging with and retaining the mating connector in the slot. A third arm is formed on a bottom side of the slot and supports a tab for engaging with the mating connector. A shielding member is positioned on and attached to the housing with two J-shaped end sections of the shielding member fit over two end blocks of the housing. The shielding member has two inclined resilient arms engaging with a flange of the casing thereby retaining and electrically grounding the connector.

BRIEF DESCRIPTION OF THE DRAWINGS

The present invention will be apparent to those skilled in the art by reading the following description of preferred embodiments thereof, with reference to the accompanying drawings, in which.

DETAILED DESCRIPTION OF THE PREFERRED EMBODIMENTS

Figure 8:
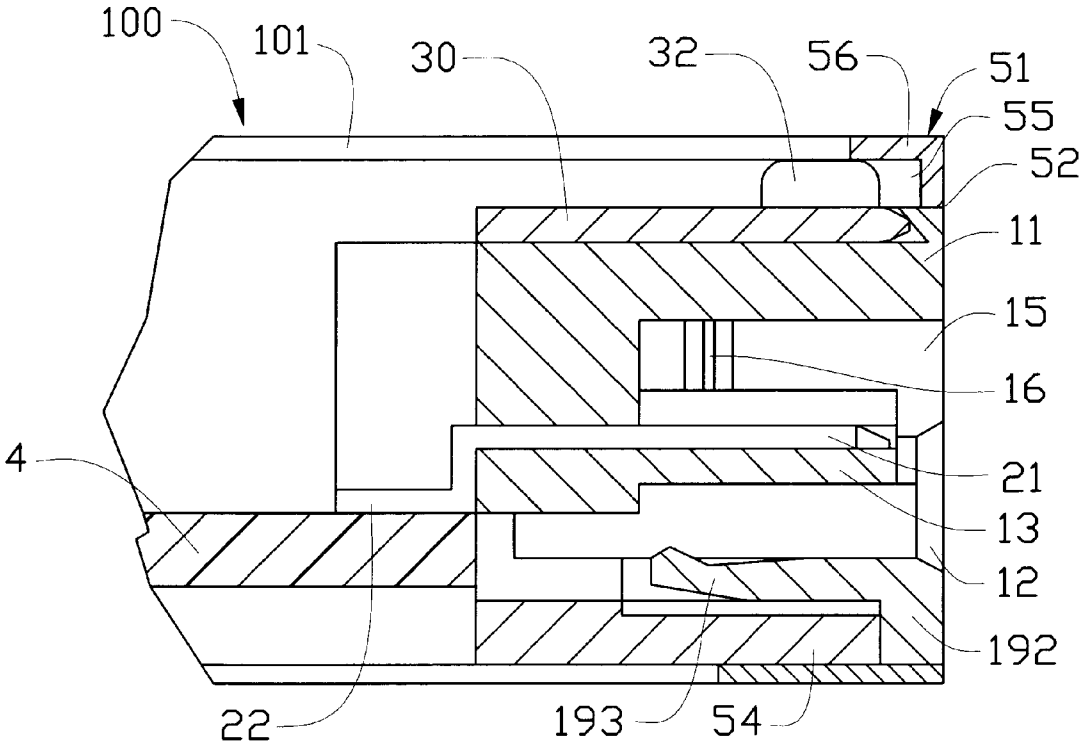
FIG. 8 is a cross-sectional view taken along line VIII—VIII of FIG. 6.

Referring to the drawings and in particular to FIGS. 1, 2A, 2B and 3, an electronic card connector 1 constructed in accordance with the present invention is adapted to be mounted in an electronic card 100 (FIG. 8). The connector 1 comprises an insulative housing 10 fixed in a casing 101 of the electronic card 100 and receiving and retaining a plurality of contact elements 20 therein. A shielding member 30 is attached to the housing 10 for providing electromagnetic interference (EMI) protection.

The housing 10 comprises a body 11 defining a slot 12 therein exposed to both a front face and an opposite rear face of the housing 10 for receiving a mating connector (not shown). A tongue 13 is fixed in the slot 12 and spaced from inner surfaces of the slot 12 for accommodating the mating connector. The tongue 13 forms a plurality of passageways 14 thereon in communication with the slot 12. Each passageway 14 receives one of the contact elements 20 therein with a mating end section 21 of the contact element 20 extending into the slot 12 for electrically engaging with contacts of the mating connector and a tail end section 22 extending beyond the rear face of the housing 10 for soldering to a circuit board 4 (FIG. 6) of the electronic card 100.

Figure 1:
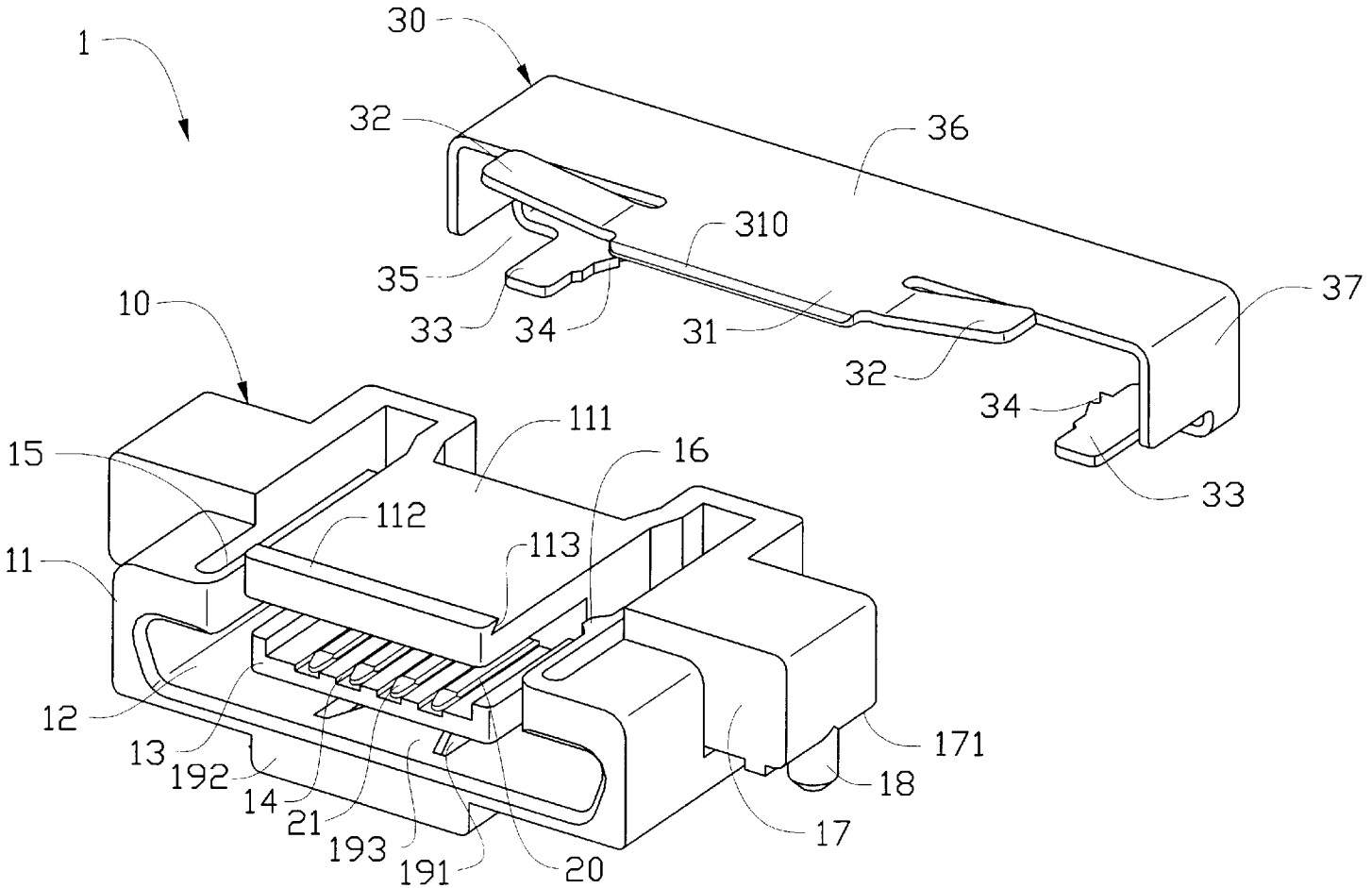
FIG. 1 is an exploded view of an electronic card connector in accordance with the present invention.
Figure 2A:
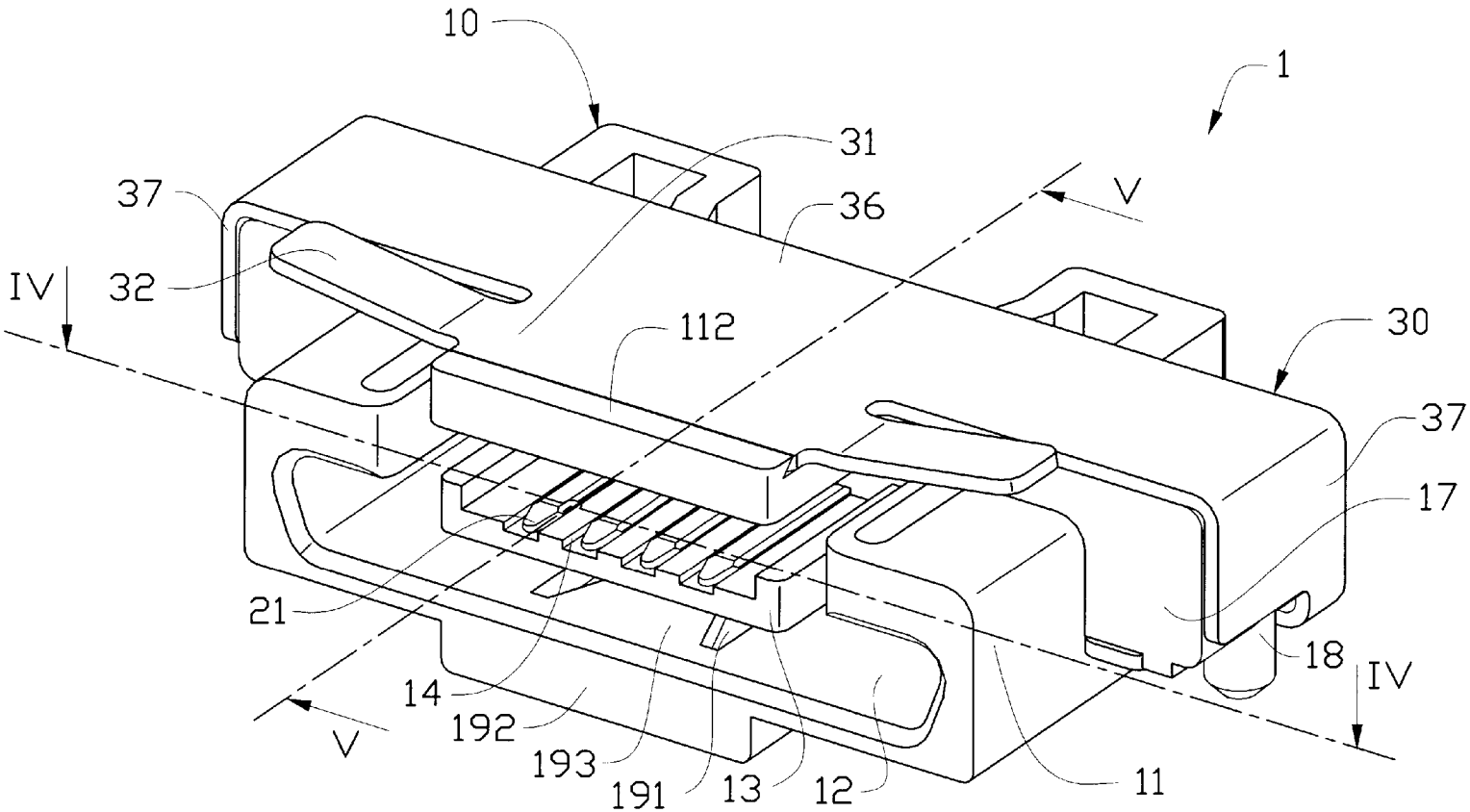
FIG. 2A is an assembled view of FIG. 1.
Figure 2B:
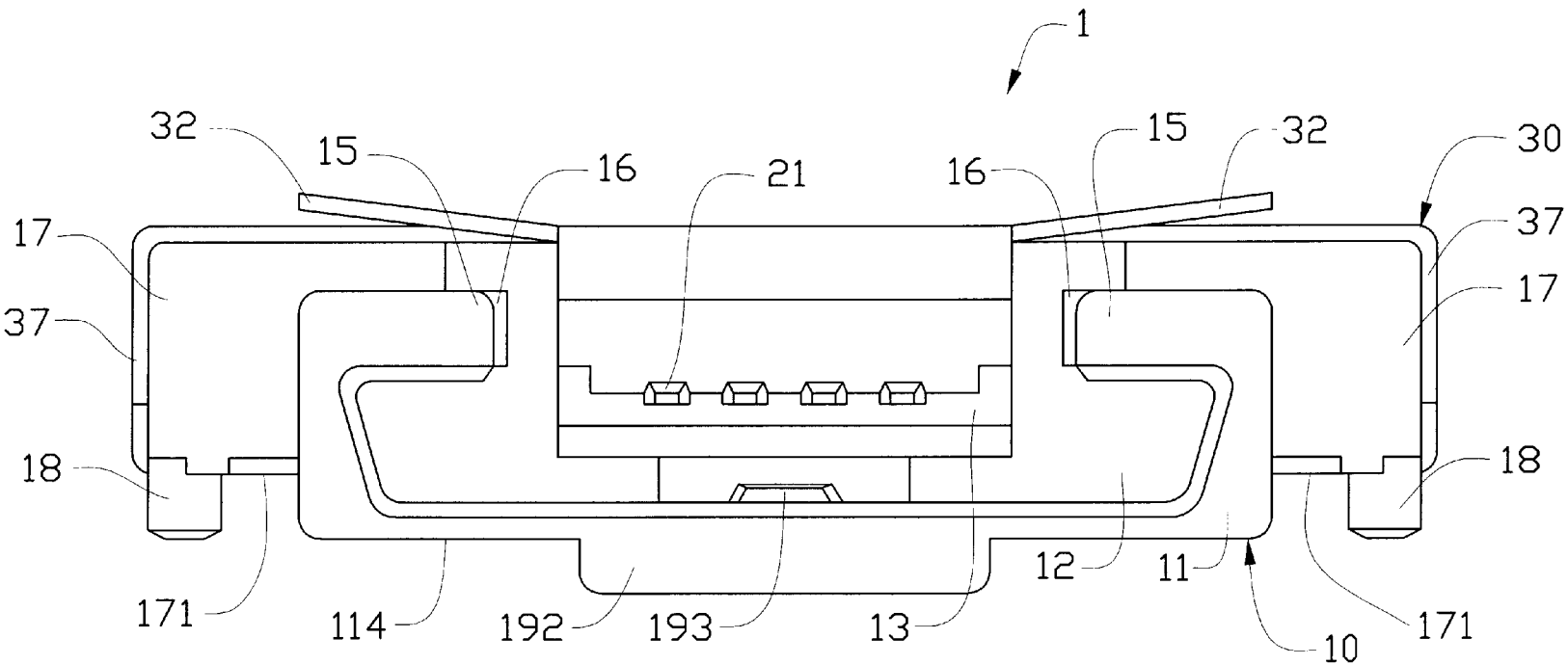
FIG. 2B is a front view of FIG. 2A.
Figure 4:
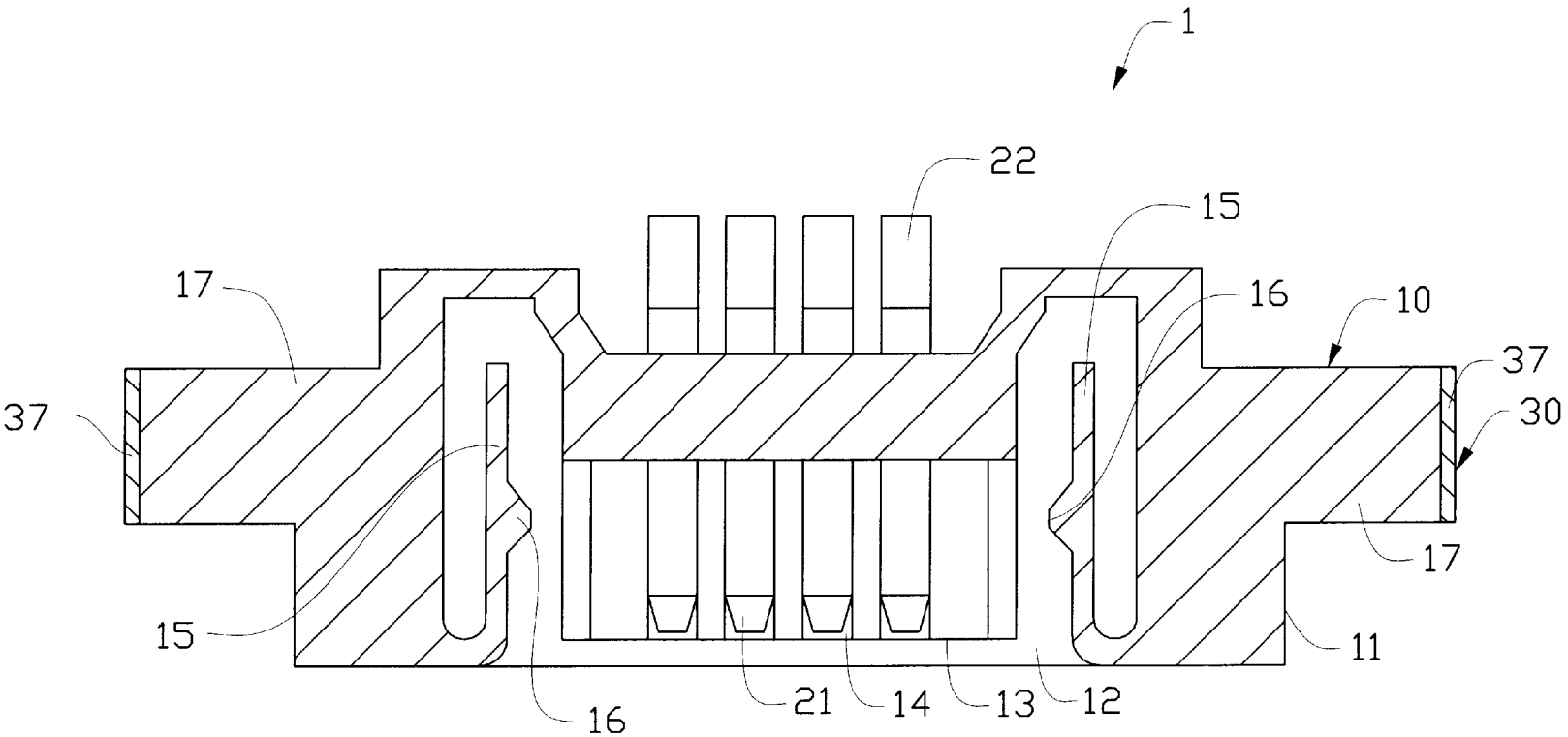
FIG. 4 is cross-sectional view taken along line IV—IV of FIG. 2A.

As most clearly shown in FIG. 4, a pair of cantilevered latching arms 15 extend from the body 11 into the slot 12. Each latching arm 15 forms a barb 16 for engaging with and retaining the mating connector in the slot 12. The latching arms 15 are deflectable thereby resiliently supporting the barbs 16. It is understood that the latching arms 15 is cantilevered on a joint around the front face, and the distal free end thereof deeply extends inward and is protectively hidden from the exterior when the shielding member 30 is attached on the top of the housing 10, as shown in FIGS. 1 and 2, thereby eliminating improper external impact upon said latching arms 15. Alternatively, the latching arms 15 may be simply supported, rather than cantilevered, for another style. A tab 193 is formed on a bottom surface of the slot 12 for engaging with and retaining the mating connector. The latching arms 15 and the tab 193 act together to releasably secure the mating connector in the slot 12.

A positioning block 192 is formed on a bottom face 114 of the body 11 of the housing 10 for positioning the connector 1 with respect to the casing 101 of the electronic card 100. In the embodiment illustrated, an opening 191 is defined through a lower portion of the body 11 of the housing 10 in communication with the slot 12. The tab 193 extends from the positioning block 192 through the opening 191 and into the slot 12 as particularly shown in FIGS. 3 and 5. Thus, the tab 193 is provided with resiliency for facilitating engagement between the connector 1 and the mating connector.

The housing 10 has two end blocks 17 formed at opposite ends of the body 11. Each end block 17 has a bottom face 171 adapted to be positioned on the circuit board 4 for supporting the connector 1 thereon. A positioning pin 18 extends from the bottom face 171 for insertion into a hole (not shown) defined in the circuit board 4 thereby positioning and retaining the connector 1 thereon.

Figure 3:
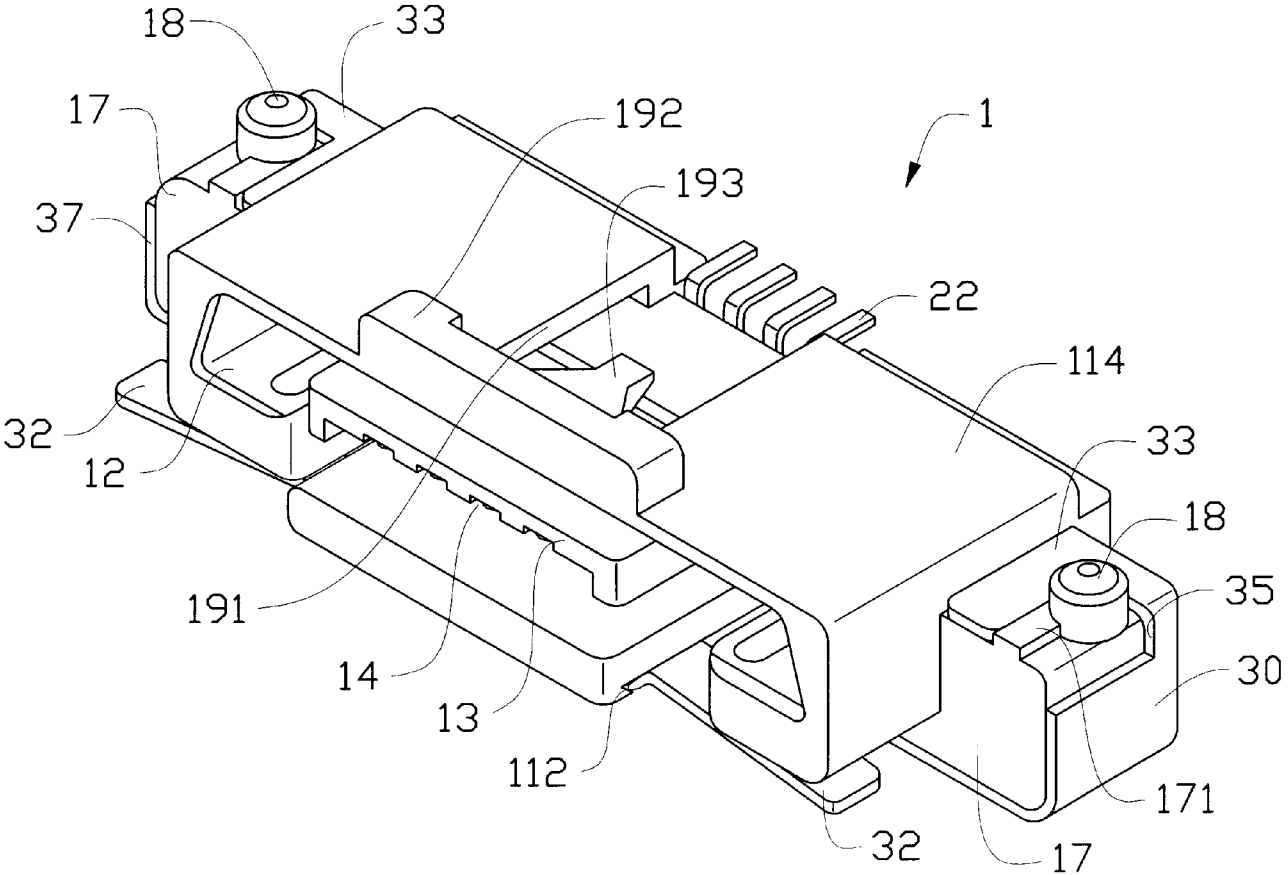
FIG. 3 is a bottom view of FIG. 2A.

The shielding member 30 comprises a central section 36 positioned on a top face 111 of the body 11 of the housing 10 and two J-shaped end sections 37 engaging with the end blocks 17 of the housing 10. Each end section 37 has an end tab 33 engaging with the bottom face 171 of the corresponding end block 17 of the housing 10. Preferably, the end tab 33 forms sharpened teeth 34 thereon for more securely engaging with the bottom face 171 of the end block 17. The end tab 33 may be soldered to the circuit board 4 for securing the connector 1 to the circuit board 4 and for grounding purposes. If desired, a cutout 35 may be defined in the end tab 33 for accommodating the corresponding positioning pin 18 of the end block 17 as shown in FIG. 3.

Figure 5:
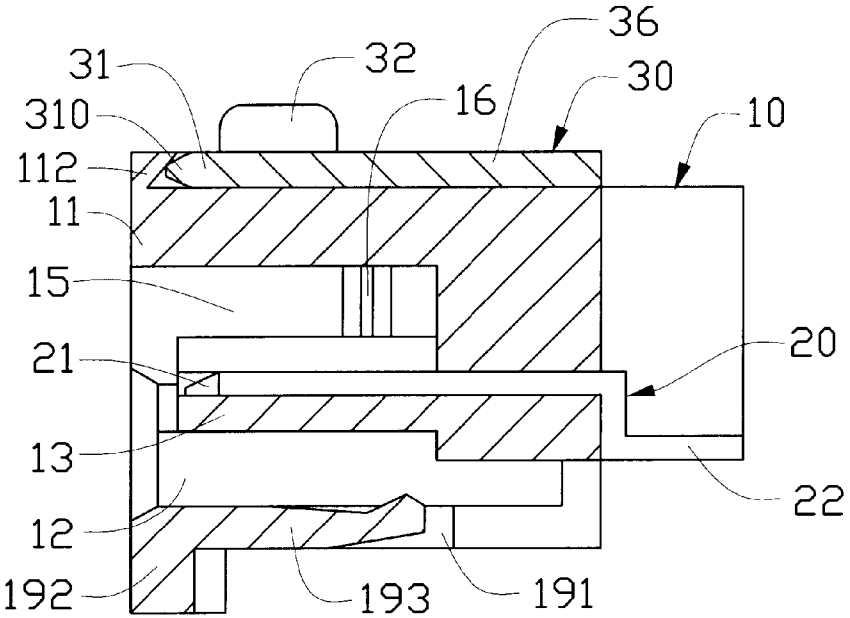
FIG. 5 is a cross-sectional view taken along line V—V of FIG. 2A.

The central section 36 has two resilient retaining arms 32 extending at an incline away from the central section 36. The central section 36 has a front flange 31 with an edge 310, preferably chamfered, received in a slot 113 defined in a projection 112 formed on the top face 111 of the body 11 of the housing 10 for further retaining the shielding member 30 on the housing 10 as shown in FIGS. 1 and 5.

Figure 9:
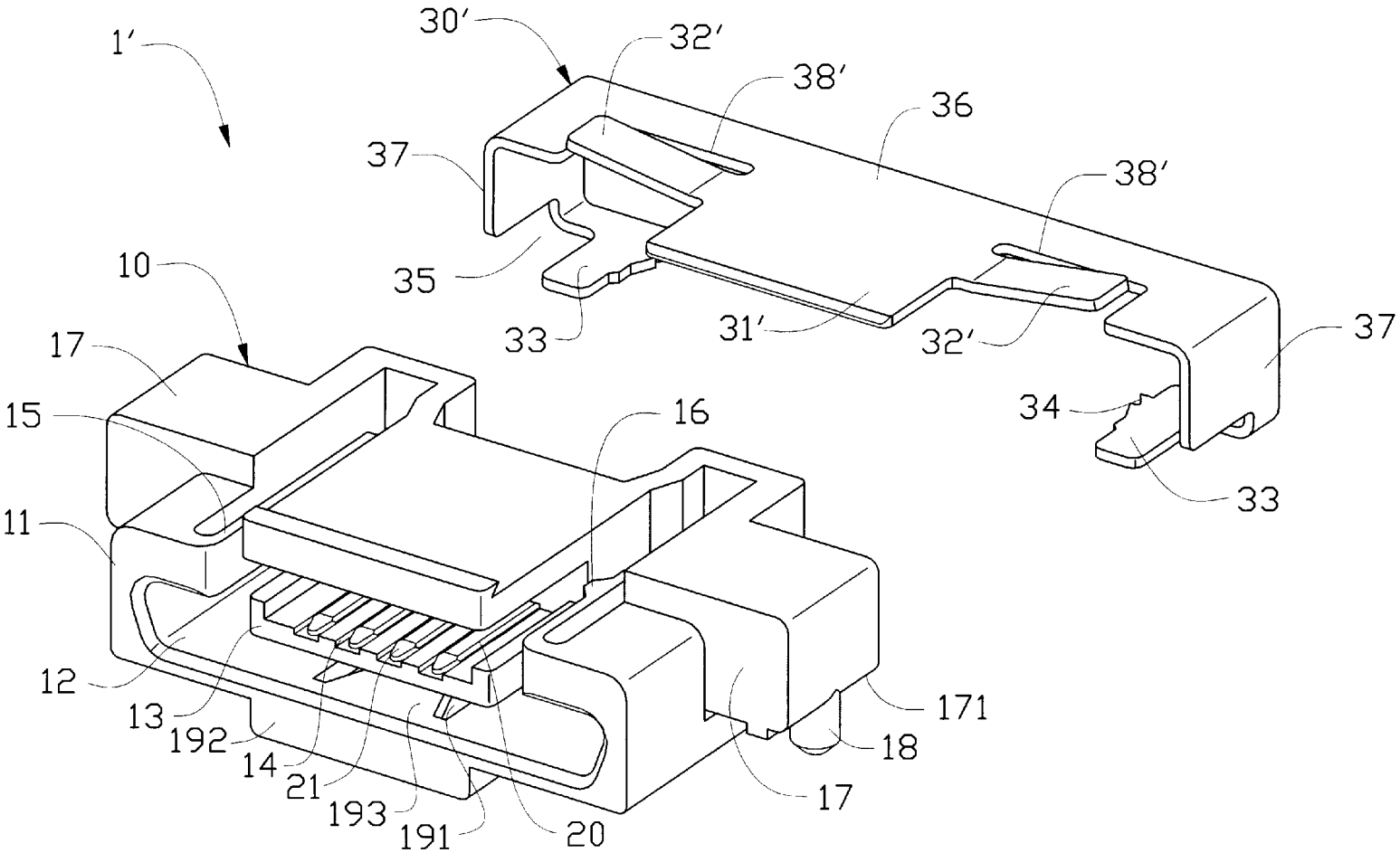
FIG. 9 is an exploded view of an electronic card connector constructed in accordance with a second embodiment of the present invention.
Figure 10:
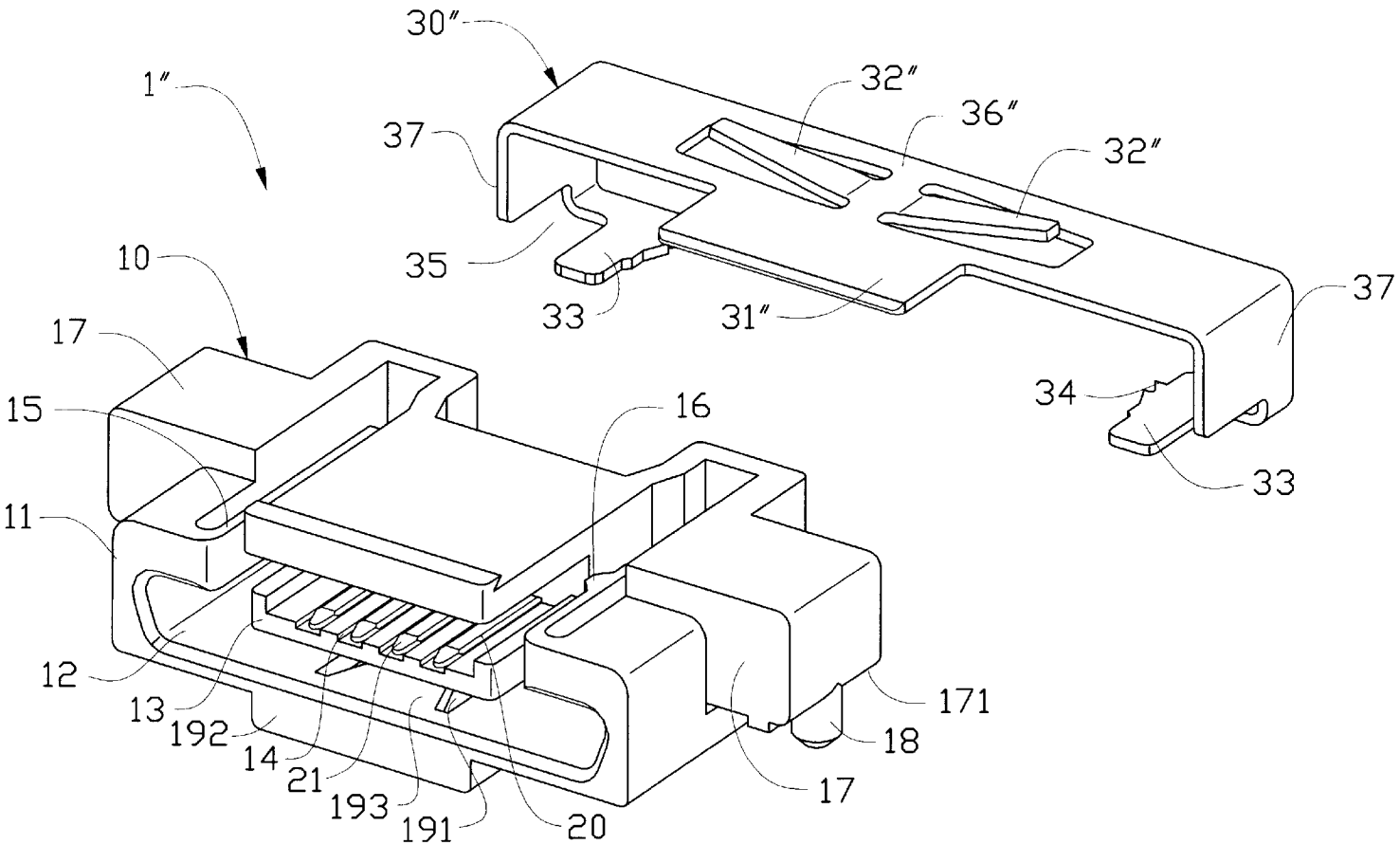
FIG. 10 is an exploded view of an electronic card connector constructed in accordance with a third embodiment of the present invention.
Figure 11:
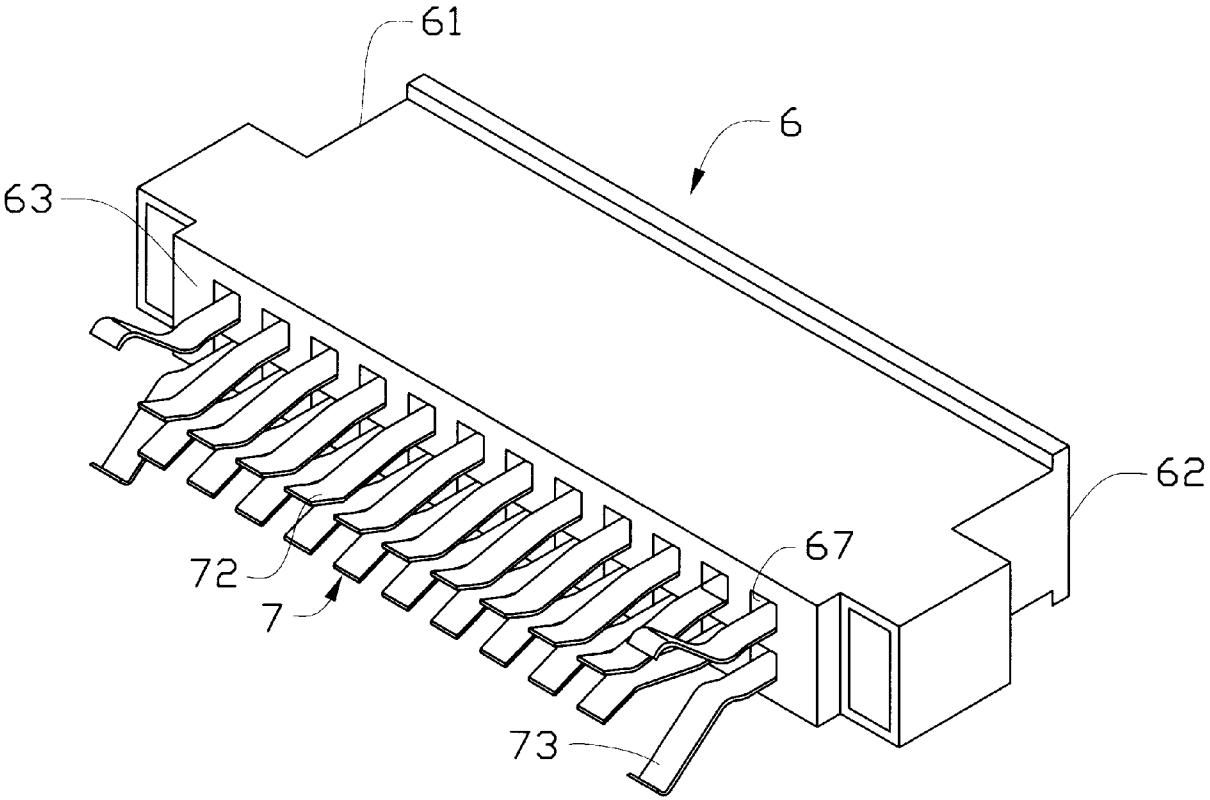
FIG. 11 (PRIOR ART)
FIG. 11 is a perspective view of a conventional electronic card connector.
Figure 12:
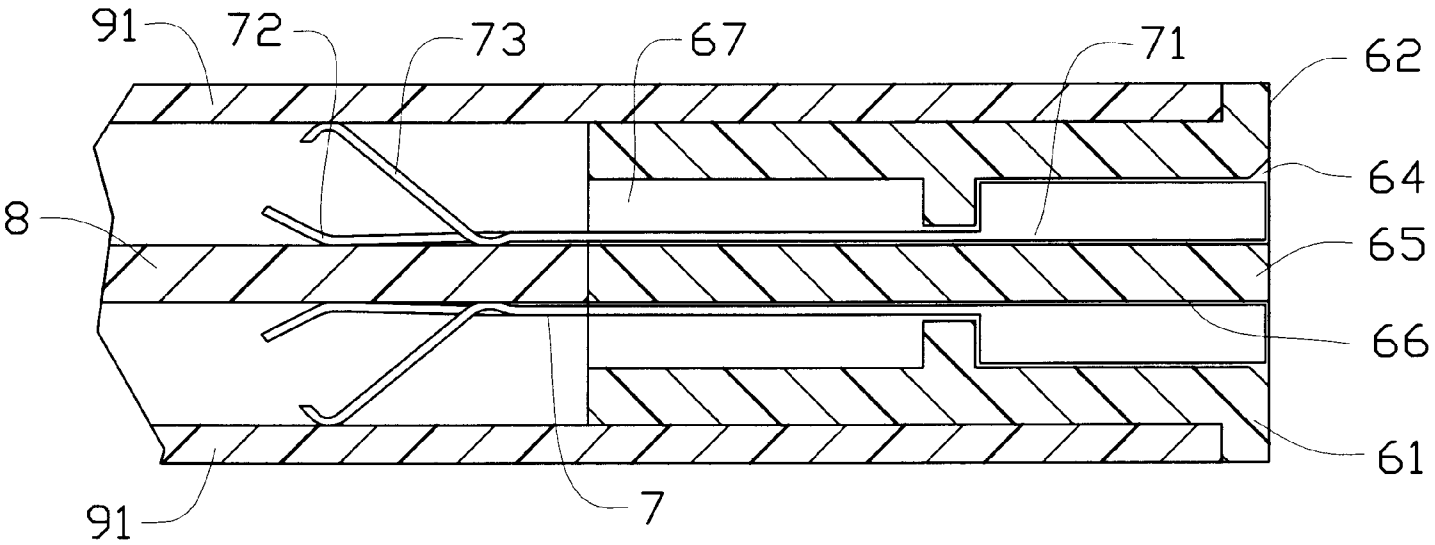
FIG. 12 (PRIOR ART)
FIG. 12 is a cross-sectional view showing the conventional electronic card connector mounted in an electronic card.

In the embodiment illustrated in FIG. 1, the front flange 31 of the central section 36 has two opposite lateral edges from which the retaining arms 32 extend. However, the retaining arms 32 may be formed differently. For example, as shown in a second embodiment of the connector 1' illustrated in FIG. 9, the connector 1' comprises a shielding member 30' having a central section 36' defining two spaced cutouts 38' with a front flange 31' formed therebetween. Two retaining arms 32' extend from opposite lateral edges of the front flange 31' into the cutouts 38'. Alternatively, as shown in a third embodiment of the present invention illustrated in FIG. 10, a connector 1" comprises a shielding member 30" having two retaining arms 32" formed in the central section 36" and extending therefrom, rather than extending from the front flange 31".

Figure 6:
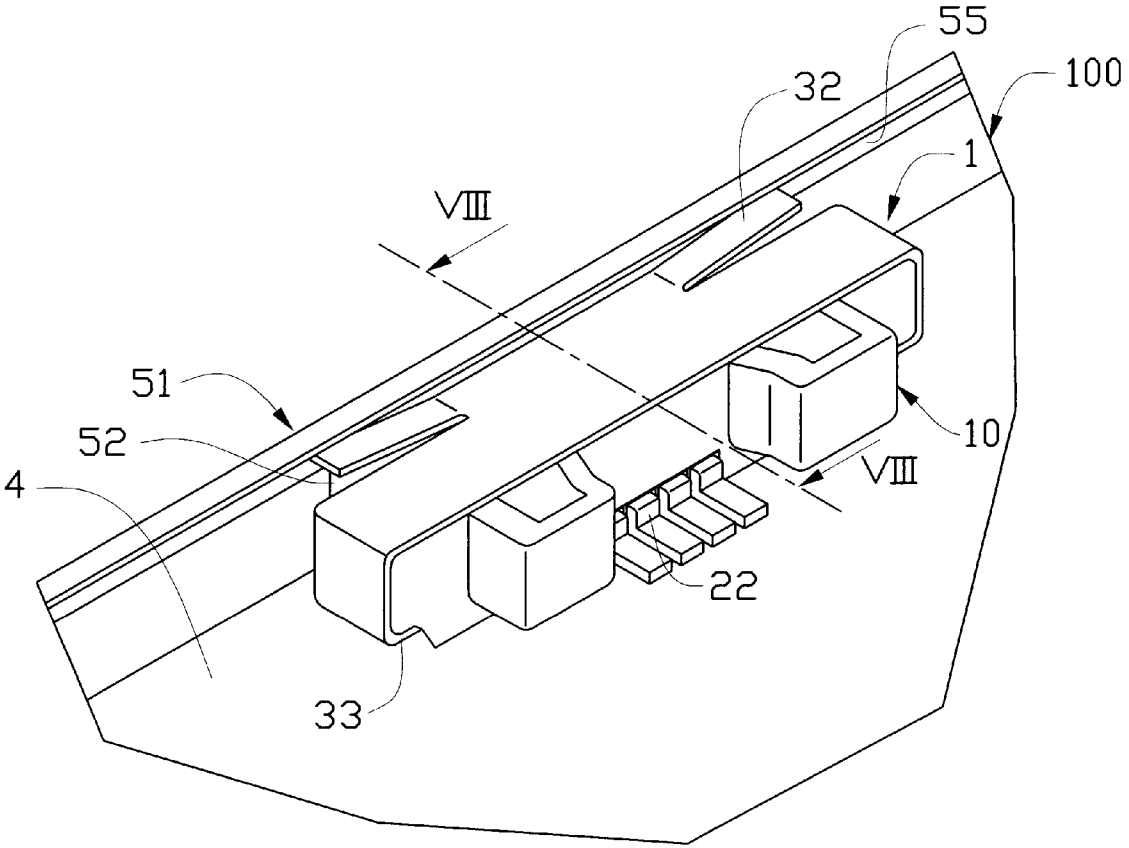
FIG. 6 is a perspective view showing the electronic card connector of the present invention mounted in an electronic card with a casing of the electronic card removed therefrom.
Figure 7:
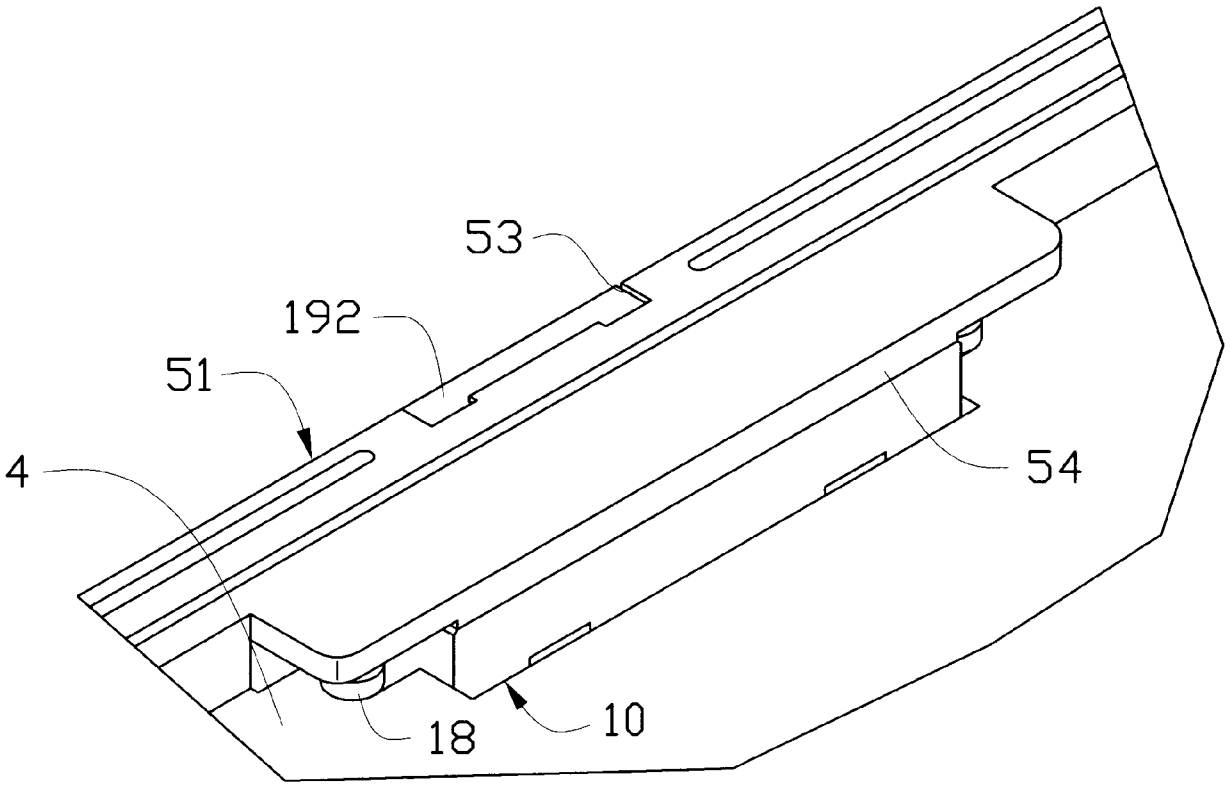
FIG. 7 is a bottom perspective view of FIG. 6.

Referring to FIGS. 6–8, the casing 101 of the electronic card 100 has a mounting frame 51 fixed to both the casing 101 and the circuit board 4. The mounting frame 51 defines an opening 52 for receiving the connector 1 with the positioning pins 18 of the connector 1 engaging with the holes of the circuit board 4 and the connector 1 supported on the circuit board 4 by the bottom faces 171 of the end blocks 17. The front face of the connector 1 is exposed through the opening 52 whereby the mating connector may engage with the connector 1 via the opening 52.

The mounting frame 51 has a top flange 56 and a bottom flange 54 defining a slot 55 therebetween for receiving the connector 1 and the circuit board 4 therein with the top flange 56 located above the circuit board 4 and the bottom flange 54 located below the circuit board 4. The bottom face 114 of the body 11 is supported by the bottom flange 54. The retaining arms 32 resiliently engage with the top flange 56 for retention and grounding purposes.

The opening 52 is further defined with a recess 53 (FIG. 7) in which the positioning block 192 of the housing 10 is received for positioning the connector 1 with respect to the casing 101 of the electronic card 100. The provision of the positioning block 192 of the housing also allows the thickness of the bottom wall of the body 11 of the housing 10 to be reduced while being supported by the bottom flange 54 of the mounting frame 51. It can be understood that the bottom wall beside the block 192 of the housing 10 is relatively thinner than that of the conventional connectors while the block still keep at least the normal thickness for overall strength consideration of the connector. Because the recess 53 extends through the casing 101 and the block 192 is received therein, the housing 10 of the connector 1 accordingly owns a lower profile with regard to the casing 101.

Although the present invention has been described with reference to preferred embodiments, it is apparent to those skilled in the art that a variety of modifications and changes may be made without departing from the scope of the present invention which is intended to be defined by the appended claims.

What is claimed is:

1. An electronic card connector adapted to be fixed in an electronic card and electrically engaged with a circuit board within the electronic card, comprising:

an insulative housing fixed to a casing of the electronic card, the housing having an outer face exposed through an opening defined in a mounting frame of the casing of the electronic card and an opposite inner face, a slot being defined in the housing between the outer and inner faces for receiving a plurality of contact elements with a tail end of each contact element extending beyond the inner face for electrically engaging with the circuit board, the slot being adapted to receive a mating connector therein for establishing electrical connection between the contact elements and the mating connector;

retaining means comprising a pair of opposing barbs resiliently supported within the slot for engaging with and thus retaining the mating connector in the slot of the housing; and a shielding member attached to the housing and comprising a central section positioned on a top face of the housing and two J-shaped end sections fit over two end blocks of the housing, each end block of the housing having a bottom face adapted to be positioned on the circuit board, each J-shaped end section of the shielding member comprising an end tab engaging with the bottom face of a corresponding end block and positioned on the circuit board of the electronic card to be electrically connected thereto, the end tab forming sharpened teeth engaging with the insulative housing.

2. The electronic card connector as claimed in claim 1, wherein a pair of resilient latching arms extend into the slot, each latching arm having one of the barbs formed thereon.

3. The electronic card connector as claimed in claim 1, wherein a pair of resilient latching arms extend into the slot proximate a first and an opposite second inside surfaces thereof, each latching arm supporting one of the barbs thereon, the retaining means further comprising a resilient tab supported on a third inside surface of the slot.

4. The electronic card connector as claimed in claim 1, wherein each end block has a positioning pin extending from the bottom face thereof for insertion into a hole defined in the circuit board.

5. The electronic card connector as claimed in claim 4, wherein the end tab of each J-shaped end section defines an opening for accommodating the positioning pin of the end block.

6. The electronic card connector as claimed in claim 1, wherein the central section of the shielding member has a front flange extending therefrom, the front flange having a front edge received in a groove defined in a projection formed on the top face of the housing.

7. The electronic card connector as claimed in claim 1, wherein the central section of the shielding member comprises two retaining arms extending therefrom at an incline away from the housing and adapted to engage with a top flange of the mounting frame of the casing.

8. The electronic card connector as claimed in claim 7, wherein the central section of the shielding member has a front flange extending therefrom and two lateral edges from which the retaining arms extend.

9. The electronic card connector as claimed in claim 7, wherein the central section of the shielding member defines two spaced cutouts forming a front flange therebetween, the front flange having two lateral edges from which the retaining arms extend.

10. The electronic card connector as claimed in claim 1, wherein the housing comprises a positioning block received in a recess defined in a bottom edge of the opening of the casing.

11. The electronic card connector as claimed in claim 1, wherein the housing comprises a positioning block received in a recess defined in a bottom edge of the opening of the casing, the mounting frame comprising a bottom flange extending from the bottom edge of the opening for supporting a bottom face of the housing.

12. An electronic card connector adapted to be fixed in an electronic card and mounted to a circuit board, comprising:

an insulative housing fixed to a casing of the electronic card, the housing having an outer face exposed through an opening defined in a mounting frame of the casing of the electronic card and an opposite inner face, a slot being defined in the housing between the outer and inner faces for receiving a plurality of contact elements with a tail end of each contact element extending beyond the inner face for electrically engaging with the circuit board, the slot being adapted to receive a mating connector therein for establishing electrical connection between the contact elements and the mating connector;

shielding means attached to the housing for providing electromagnetic interference protection; and retaining means for securely retaining the mating connector in the slot, said retaining means comprising a pair of opposing barbs supported in the slot for engaging with and retaining the mating connector therein.

13. An electrical connector comprising:

an insulative housing defining a front face and a rear face;

a plurality of contact elements received within said housing;

a slot defined in the housing between said front and said rear faces for receiving a complementary mating connector;

a pair of resilient latching arms integrally extending rearward from the front face in a cantilevered manner by two sides of the slot and communicatively facing to said slot for latching said mating connector therewith; and a shielding member covering a top face of the housing so that a distal end of each of said latching arms, which extends inwardly deeply, can be fully protectively hidden for not being influenced by any external impact.

14. An electronic card (100) comprising:

a casing (101) including a mounting frame (51), said frame defining an opening (52) with a recess (53) thereabouts;

an electrical connector (1) including an insulative housing (10), said housing (10) defining an outer face exposed through said opening (52) and an opposite inner face, a slot (12) being defined in the housing (10) between the outer and inner faces for receiving a mating connector;

a plurality of contact (20) elements disposed within the housing (10); and the housing (10) defining a block (192) with a relatively thinner bottom wall by two sides thereof wherein the block (192) is received within the recess (53) while the bottom wall is supportably seated on the frame (51).

* * * * *